United States Patent [19]

Barnes

[11] Patent Number: 4,809,754

[45] Date of Patent: Mar. 7, 1989

[54] CURVE VENEER CLIPPER

[75] Inventor: Derek Barnes, Vancouver, Canada

[73] Assignee: MacMillan Bloedel Limited, Canada

[21] Appl. No.: 178,965

[22] Filed: Apr. 7, 1988

[51] Int. Cl.[4] ..... B27M 1/08; B27L 5/00

[52] U.S. Cl. ..... 144/3 R; 83/71; 83/73; 83/370; 144/209 R; 144/357; 144/365; 144/367

[58] Field of Search ..... 83/71, 73, 368, 370, 83/371; 144/1 R, 3 R, 209 R, 357, 365, 367

[56] References Cited

U.S. PATENT DOCUMENTS

| | | | |
|---|---|---|---|
| 3,244,206 | 4/1966 | Bossen | 144/209 R |
| 3,845,679 | 11/1974 | Rhotert | 83/370 |
| 4,731,733 | 3/1988 | Knoll | 83/71 |
| 4,732,183 | 3/1988 | Barnes | 144/365 |

*Primary Examiner*—W. Donald Bray
*Attorney, Agent, or Firm*—C. A. Rowley

[57] ABSTRACT

A method and apparatus for tapered peeling of veneer to form a curved veneer and clipping the curved veneer into discreet sheets by adjusting the angular relationship of the clipping knife to the axis of rotation of the bolt being peeled thereby to clip the veneer along lines substantially radial to the curvature of the veneer adjacent to the point of clipping.

In the preferred arrangement two clippers are used in series and their angular relationship adjusted relative to the axis of rotation of the bolt to produce a veneer sheet with substantially parallel sides and to remove a substantially triangular piece between adjacent clipped sheets.

6 Claims, 3 Drawing Sheets

CURVE VENEER CLIPPER

FIELD OF THE INVENTION

The present invention relates to the clipping of peeled veneer into discrete portions, more particularly the present invention relates to a system for clipping taper peeled veneer having one side edge longer than the other, by adjusting the angular position on one or more clipping knives relative to the path of travel to compensate for the curving of the veneer.

BACKGROUND TO THE PRESENT INVENTION

In the production of veneer particularly for the manufacture of plywood, it is customary to peel a bolt of wood on a lathe using a cutting edge substantially parallel to the axis of rotation of the bolt thereby to produce a length of veneer with both side edges essentially the same length so a uniform thickness veneer with little or no tendency to curve is produced.

A system has recently been devised for tapered peeling veneer to increase the yield from a log or bolt and improve, for some purposes, the quality of the veneer being produced. Such a system is described in Canadian Application No. 535,219 filed Apr. 21, 1987 by Barnes (U.S. Application No. 040,331 filed Apr. 21, 1987 by Barnes, now U.S. Pat. No. 4,732,183).

When veneer is peeled on a taper as defined in the Barnes application the side edge of the veneer cut at the larger diameter end of the bolt is longer than the side edge of the veneer formed from the smaller diameter end of the bolt. Veneer cut in this manner tends to curve and cannot be clipped in the conventional manner if the main advantages of tapered peeling are to be better ensured.

In a companion application by R. M. Knudson filed on the same day as this application a system of clipping is described wherein full or partial panels or sheets are formed by clipping. A clipping knife is angularly adjusted relative to the axis of rotation of the block during peeling to clip full panels with thin sides parallel and partial panels with thin sides at an acute angle. These partial panels are preferrably half panels so that two can be coupled together (after rotating 180°) to form a full panel having parallel side walls and thereby minimize waste.

BRIEF DESCRIPTION OF THE PRESENT INVENTION

It is an object of the present invention to provide a clipping system for curved veneer formed by taper peeled wherein a clipper knife is adjusted as the veneer travels therepast, to reorient the knife relative to the axis of rotation of block into a position to clip the curved veneer substantially radially of the curvature of the peeled veneer adjacent the clip.

Broadly, the present invention relates to clipping a curved veneer having one curved side edge longer than the other curved side edge into discrete segments each defined by pair of opposed curved side edges one longer than the other and a leading and trailing end edge comprising peeling a block of wood rotating on an axis using a peeling edge, adjusting the angle of a clipper knife to said axis of rotation to clip the veneer into discreet panels each having its leading and trailing edges substantially radial to the curvature of the veneer at the location of each of said leading and trailing edges.

The present invention will normally comprise means for sensing a bolt to determine the size (diameter) of the bolt and its taper, means to position said bolt for rotation on an axis of rotation based on the size and taper of said bolt sensed by said sensing means, means to rotate said bolt on said axis of rotation, a peeling knife, means to adjust the angle of said peeling knife to the axis of rotation of said bolt in accordance with the sensed taper of said bolt thereby to peel a veneer having a longer and a shorter curved side edge, a clipper knife closely coupled relative to said peeling knife and located along the path of travel of said veneer from said peeling knife, computer means for determining the curvature of at least one of said longer or shorter curved side edges based on the size of said bolt, the cutting angle of said peeling knife and the position of said peeling knife, means to angularly adjust said clipper knife to extend substantially radially of the curvature of said veneer adjacent said clipper knife when said clipper knife is actuated to clip said veneer into sheets.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF PREFERRED EMBODIMENTS

Figure 1:
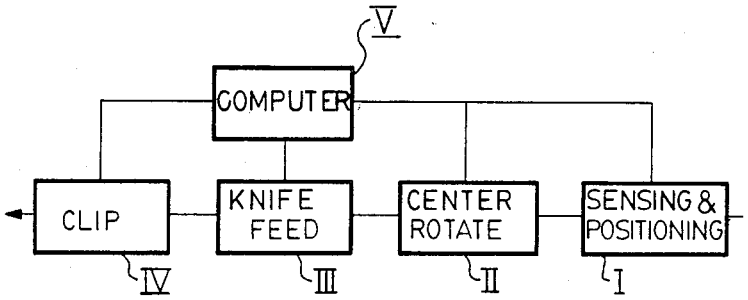
FIG. 1 is a schematic illustration of the operation of the present invention.

FIG. 1 schematically illustrates via a box diagram various steps to accomplish the desired results of the present invention. In the preferred arrangement, the wood bolt to be processed is first sensed in sensing and positioning station I wherein the diameter of the bolt is determined as well as its taper shape. The bolt is then positioned in accordance with the information obtained at station number 1 and mounted in the centering and rotating section II with the selected longitudinal axis of the bolt forming the axis of rotation. The peeling knife feed indicated by box III is controlled in accordance with the axis of rotation of the bolt so that the cutting edge of the knife is correlated with the taper of the bolt to position the cutting edge of the knife at an angle to the axis of rotation and peel a veneer that is longer on one side than the other. This veneer then clipped in clipping station IV in a selected pattern as will be described in more detail hereinbelow. The computer station V correlates the input from the various stations to control the operation of the station to cut and clip the veneer.

Devices represented by the boxes I, II and III may be essentially the same as those described in said Barnes application, however, the clipping station IV which forms an important portion of the present invention is significantly different as is the computer station V which must also control the clipping station IV.

Figure 2:
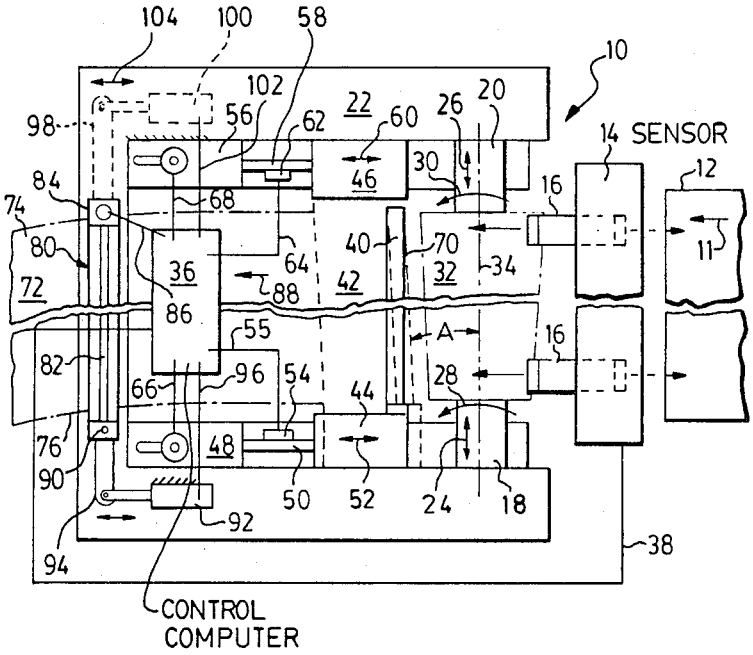
FIG. 2 is a schematic plan view of a lathe adapted to cut on a taper close coupled with a clipper incorporating the present invention.

Referring to FIG. 2 the general layout of the various stations is shown in more detail. Wood bolts are fed to the lathe 10 on a suitable infeed layer 12 in a direction as indicated by the arrow 11 with their longitudinal axes substantially perpendicular to the direction of travel 11. The bolts first pass into a sensor 14 that determines the size and shape of the bolt, i.e. the diameter and taper. The bolt is then oriented via a positioner 16 on a selected axis of rotation based on information sensed by sensor 14 and then moved into position in the lathe where it will be rotated for peeling. In this case the bolt is oriented and positioned by positioner 16 between movable chucks schematically indicated as 18 and 20 mounted in the frame 22 of the lathe for axially movement as indicated by the arrows 24 and 26 rotation as indicated by the arrows 28 and 30. A bolt as such indicated at 32 is held in and rotated by the chucks 18 and 20 on its rotational axis as indicated at 34.

The information obtained in the sensor 14 is used to position the bolt 32 in the chucks 18 and 20, i.e. align the selected longitudinal axis of the bolt on the rotational axis 34 defined by the lathe chucks 18 and 20.

Control computer 36 receives information via line 38 from the sensor 14 and controls the feed of peeling knife schematically illustrated at 40 in accordance with the sensed shape and axis of rotation 34. The peeling knife 40 is mounted on knife carriage 42 the opposite ends of which are mounted on sides 44 and 46 respectively.

The block 44 is driven by a suitable drive such as a hydraulic cylinder means 48 and piston rod 50 which is connected to the block 44 to move the block 44 toward and away from the axis of rotation 34 of the bolt 32 as indicated by the arrow 52. Movement of the shaft or piston rod 50 is measured by a suitable measuring means 54 which communicates this information to the control computer 36 so that the position of the block 44 is known. Similarly, the hydraulic cylinder 56 operates the shaft or piston rod 58 to move the block 46 toward and away from the axis 34 as indicated by the arrow 60. The sensor 62 senses the movement of the piston rod 58 and this information is fed to the control computer 36 via line 64 so that the position of the block 46 is known.

The control computer 36 independently controls via lines 66 and 68 the hydraulic cylinders or drives 48 and 56 respectively so that each end of the knife 40 is independently advanced and the angle of the cutting edge 70 of the knife 40 is adjusted relative to the axis of rotation 34 of the bolt 32 so the knife 40 peels at the desired angle to the axis 34.

When a tapered log or bolt 32 is centered for rotation on rotational axis 34 the knife blocks 44 and 46 are independently advanced to bring the cutting edge 70 into proper cutting angle relative to the axis 34 in accordance with the information provided by the sensor 14. With the larger end of the bolt 70 mounted in the chuck 20 the block 44 is advanced toward the axis 34 relative to the block 46, i.e. to the dash line position illustrated in FIG. 2 so that the cutting edge 70 is now at an angle A to the axis 34. This angle A is determined by the shape of the log or bolt 32 turning in the lathe as described in the said Barnes application to peel either a uniform thickness veneer or tapered cross-section veneer widening from the small diameter end of bolt 32 toward the larger diameter end of bolt 32.

Cutting edge 70 will normally be in the horizontal plane containing the axis 34 and the angle A is measured in that plane.

The angle A may be adjusted in accordance with various scenarios as defined in the said Barnes application, however, the present invention is concerned with those scenarios wherein the angle A is an acute angle and the bolt 32 is cut on a taper so that the veneer schematically illustrated at 72 has a long edge 74 and a shorter edge 76 with longer edge 74 being cut at the end of the knife 40 adjacent to the larger diameter end of the block or bolt 32, i.e. at the maximum radius of the taper cut, and the shorter edge 76 formed at the opposite end of the knife 40, i.e. at the end of the knife 40 closer to the axis of rotation 34.

The clipper indicated at 80 includes a clipper knife schematically illustrated at 82 moved to and from clipping position via a motor or the like indicated at 84 the timing of which is controlled by the computer control 36 via line 86 as will be described in more detail hereinbelow.

Clipper mechanism particularly the blade 82 is mounted in a suitable manner so that its angular relationship to the path of travel of the veneer 72 can be adjusted as required, i.e. change its angle to the path of travel as indicated by the arrow 88 of a veneer cut with the peeling edge 70 substantially parallel to the axis of rotation 34, i.e. in the path 88 is substantially perpendicular to the axis 34.

In the illustrated arrangement this angular adjustment is obtained by mounting the clipper 80 on the frame 22 on a pivot pin 90 to the frame and pivoting the clipper 80 on the axis 90 by a piston and cylinder 92 connected to an arm 94 extending from the clipper 80. The operation of the piston and cylinder 92 is controlled via the control computer 36 through line 96 to move the arm 94 as indicated by the arrow 95 thereby angularly positioning the blade 82 relative to the path of travel 88 in a manner that will be described in more detail hereinbelow.

As schematically illustrated the clipper 80 may be mounted in other ways and the pivot pin 90 be eliminated. For example the clipper 80 may be mounted so that both ends may be individually moved by eliminating pivot pin 90 and providing an extension arm 98 connected to a piston and cylinder 100. The operation of the piston and cylinder 100 is controlled by the control 36 via line 102 to move the arm 98 as indicated by the arrow 104. In the latter arrangement the angular position of the clipper 80 and thereby the knife 82 relative to the path of travel 88 is controlled by the coordinated movement or operation of the piston and cylinder 92 and 100 as will be described in more detail hereinbelow.

Figure 3:
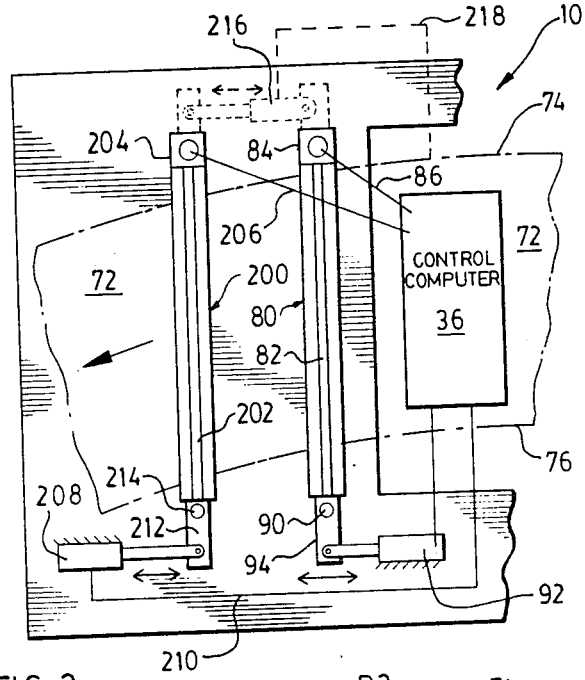
FIG. 3 is a schematic plan view of a clipper employing two relatively moveable clipper knives for cutting veneer at different angles.

The system shown in FIG. 3 is similar to that shown in FIG. 2 however a second clipper 200 has been added. This clipper 200 will be essentially the same as the clipper 80 and will have a knife 202, and an actuator 204 controlled by computer 36 as indicated by the line 206. The clipper 200 is angularly adjustable relative to the axis 34 independent of the angular adjustment of the clipper 80 by means such as the piston and cylinder arrangement 208 operation of which is controlled by the computer 36 as indicated by the line 210. Movement of the clipper 200 is obtained through the connection between the piston cyliner 208 and arm 212 extending from the clipper 200. The action of the piston and cylinder pivots the clipper 200 around the axis 214.

Alternatively the clipper 200 may be mounted via pistons and cylinders at opposite ends as described herein above with respect to piston and cylinder 100 and the arm 98 for the clipper 80 i.e. the pivot pin 214 will be eliminated and a separate piston and cylinder provided to position the opposite end of the clipper.

Yet another alternate way of adjusting the angular relationship of the knife 200 to the axis of rotation 34 would be to eliminate the piston and cylinder 208 and replace it with a piston and cylinder 216 operating between the ends of the clippers 80 and 200 to pivot the clipper 200 around the axis 214 under control of the computer 36 which controls the piston cylinder 216 via line 218. Basically the piston cylinder 216 changes the angular relationship between the clipper knife 82 and 202 so that the precise angle of clipper knife 202 to the axis 34 is controlled by the combined operation of the piston and cylinder 92 and the piston and cylinder 216.

Various strategies for operating the clipper are disclosed.

Figure 4:
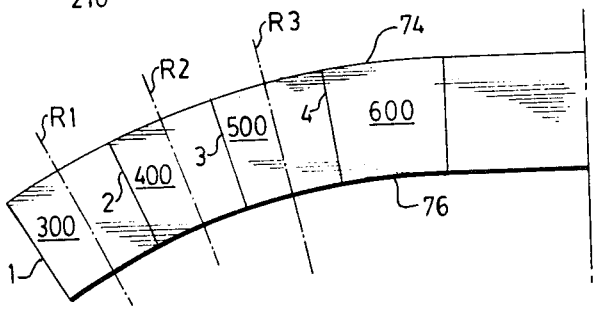
FIG. 4 is a plan view of a continuous sheet of veneer illustrating one clipping strategy incorporating the present invention.
Figure 5:
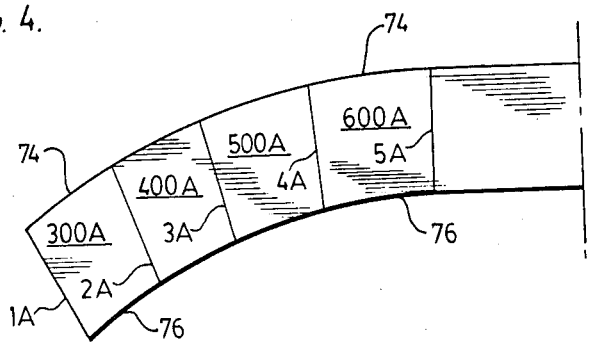
FIG. 5 is a view similar to FIG. 4 showing a modified strategy.
Figure 6:
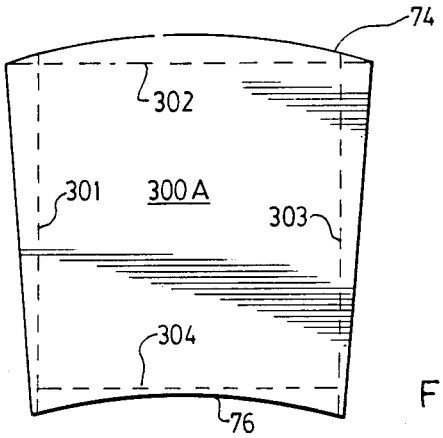
FIG. 6 is a plan view of a panel clipped in accordance with the strategy of FIGS. 4 or 5 of the present invention.

In the arrangement shown in FIGS. 4, 5 and 6 only the clipper 82 will be used. In this arrangement a first panel 300 is formed by first clip numbered 1 and a second clip 2. These clips 1 and 2 are substantially parallel to a radius R1 which is essentially on a radial line based on the curvature of the veneer at the mid point of panel 200. Thereafter panels 400, 500 etc, the clip 3 which defines one side of panel 400 and a side of panel 500 is along a line substantially parallel to the radius through the mid point of panel 400 clip 4 which defines one side of panel 500 and of panel 600 is substantially parallel R3 which is the radius at the mid point of the panel 500 etc.

In a more practical arrangement as shown in FIG. 5 each of the clips defining the sides of the panels are clipped along a radius based on the curvature of the veneer sheet at or adjacent to the clip line i.e. clip 1A would be radial to the leading end of the veneer being peeled based on the curvature of the veneer at that point. Clip 2A defining the other side of panel 300 from the side defined by clip 1A could be substantially radial to the curvature of the veneer at the clip line and similarly clip lines 3A, 4A etc will all be substantially radial based on the actual curvature of the veneer at or adjacent each of the respective clip lines.

It will be apparent that this procedure does not produce a rectangular panel or sheet for laying up to form a plywood laminate and the sheet must be cut bigger than that required for producing a laminate so that it may be trimmed as indicated for the sheet 300A in FIG. 6 by trimming along the lines 301, 302, 303 and 304. The lines 301 and 303 are substantially parallel as are the lines 302 and 304 and the lines 302 and 304 are perpendicular to the lines 301 and 303.

It is not necessary to do all of the trimming operations before laying up. For example it is only necessary to cut a first trim line such as trim line 301 which can then be used as a datum edge for guiding the panel through the layup system and press with the final trimming taking place in the normal trimming operation in the plywood mill i.e. trim cuts 302, 303 and 304 would be performed after the sheet 300A has been added to other sheets to form a layup for plywood and the plywood trimmed to its final size.

Figure 7:
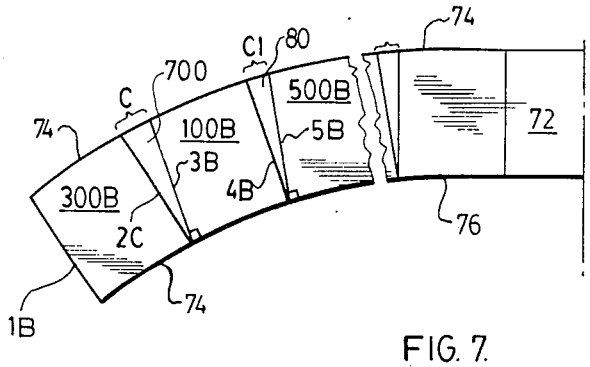
FIG. 7 is a schematic of a further clipping strategy using a pair of clipper knives as illustrated in FIG. 3.
Figure 8:
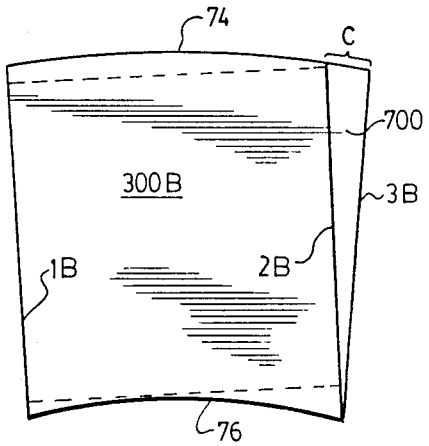
FIG. 8 is a plan view of a panel clipped using the strategy illustrated in FIG. 7.

In FIG. 7 a modified technique for clipping is illustrated. In this arrangement clipping mechanism schematically illustrated in FIG. 3 is employed.

At the beginning the first edge 18 may be cut by either the knife 82 or the knife 202 may be used. This initial cut will normally be substantially radial to the curvature of the veneer at the line of cut or as above indicated could, for example, be parallel to the radius at the mid point of the panel 300B.

In any event the next cut or clip 2B must be performed by the clipper closest to the axis of rotation 34 of the bolt. This clip line 2B will be substantially parallel to the initial cut 1B and will define the opposite side of the panel 300B to the side defined by the clip line 1B.

The clipper knife 202 preferably will be oriented to be substantially radial to the curvature of the veneer at the location of the clip line 3B thus there will be a correction C at the longer edge 74 the veneer 72. This correction C will be determined by the difference in angular relationship between the cuts 2B and 38 which will align the cut 3B to be substantially radial relative to the curvature of the veneer 72 or as above described for example parallel to the radius at the mid point of the panel or sheet 4008, one side of which is defined by the clip 3B. The clip 38 will be formed by the clipper knife 202 i.e. a knife farthest away from the axis of rotation 34 so that the clipping operation separates the substantially triangular waste piece 700 from the leading end of the sheet extending from the lathe rather than attempting to separate the waste piece from the discreet panel.

The next clip line 4B will be formed by the clipper knife 82 and the clipper knives 82 and 202 will operate alternatively as long as there is a triangular waste sheet being formed. If the veneer becomes relatively straight and no triangular waste sheet is formed then only one clipper need be used.

In any event the clip 4B will be substantially parallel to the clip 3B so that the clips 3B and 4B define opposite parallel edges of the veneer sheet 400B.

The next clip 500B will be performed by the knife or cutting edge 202 at an angle (radial to the curvature of the veneer) so there is a triangular waste sheet 800 formed between the clips 4B and 5B and the ends of the clip lines 4B and 5B at the larger radius side of the veneer 72 will be spaced by a distance correction C1.

Obviously the clip line 5B forms one side of the panel 500B and the opposite side will be formed by a clip line substantially parallel to the clip line 5B and this process will be continued so that discreet sheets with substantially parallel side edges will be formed and these sheet can then be fed directly (without further clipping to provide a datum edge) into the plywood mill.

If the grain angle in the sheet is not important for the particular use to which the veneer is to be put, then the system illustrated in FIGS. 4 and 5 is probably the simplest mode of operation. One of the side edges of the panel say side edge 1 or 1A for the panel 300 or 300A may be used as a datum and the panel fed through the plywood equipment using that edge as a guiding edge. Obviously this arrangement would not result in the grain direction being parallel to a longitudinal axis of the resultant plywood panel although it may be acceptable. For aesthetic reasons and in some cases strength reasons it is preferred to have the grain direction aligned with the longitudinal direction of the fabricated or laminated plywood material and for this reason the datums should be substantially parallel to the average grain direction in each discreet sheet.

Table I indicates the length of veneer cut from a log or bolt with the cutting edge 70 at an angle A to the axis of rotation 34 wherein the length of the veneer in the grain direction is about 2.6 m; the large diameter end of the bolt adjacent to the chuck 20 is about 356 mm, the small diameter of the bolt adjacent to the chuck 24 is about 381 mm; and a tapered thickness veneer is cut having a thickness at the larger diameter end of the bolt of about 2.7 mm, and at the smaller diameter end of the bolt of about 2.4 mm for a nominal veneer thickness of 2.5 mm (i.e. an average thickness of 2.5 mm).

TABLE I

Small end Bolt Diameter, mm = 356
Large End Bolt Diameter, mm = 381
Minimum Core Diameter, mm = 101
Nominal Veneer Thickness, mm = 2.5

| | Small End | | | Large End | | | |
|---|---|---|---|---|---|---|---|
| Rev No. | Veneer Thick mm | Core Dia mm | Edge Length mm | Veneer Thick mm | Core Dia mm | Edge Length mm | Length Difference mm |
| 1 | 2.413 | 353 | 1110 | 2.667 | 378 | 1189 | −79 |
| 2 | 2.413 | 348 | 1094 | 2.667 | 373 | 1172 | −78 |
| 3 | 2.413 | 344 | 1079 | 2.667 | 368 | 1155 | −76 |
| 4 | 2.413 | 339 | 1064 | 2.667 | 362 | 1138 | −74 |
| 5 | 2.413 | 334 | 1049 | 2.667 | 357 | 1122 | −73 |
| 6 | 2.413 | 329 | 1034 | 2.667 | 352 | 1105 | −71 |
| 7 | 2.413 | 324 | 1019 | 2.667 | 346 | 1088 | −69 |
| 8 | 2.413 | 319 | 1003 | 2.667 | 341 | 1071 | −68 |
| 9 | 2.413 | 316 | 988 | 2.667 | 336 | 1055 | −67 |
| 10 | 2.413 | 310 | 973 | 2.667 | 330 | 1038 | −65 |
| 11 | 2.413 | 305 | 958 | 2.667 | 325 | 1021 | −63 |
| 12 | 2.413 | 300 | 943 | 2.667 | 320 | 1004 | −61 |
| 13 | 2.413 | 295 | 928 | 2.667 | 314 | 987 | −59 |
| 14 | 2.413 | 290 | 912 | 2.667 | 309 | 971 | −59 |
| 15 | 2.413 | 286 | 897 | 2.667 | 304 | 954 | −57 |
| 16 | 2.413 | 281 | 882 | 2.667 | 298 | 937 | −55 |
| 17 | 2.413 | 276 | 867 | 2.667 | 293 | 920 | −53 |
| 18 | 2.413 | 271 | 852 | 2.667 | 288 | 904 | −52 |
| 19 | 2.413 | 266 | 837 | 2.667 | 282 | 887 | −50 |
| 20 | 2.413 | 261 | 822 | 2.667 | 277 | 870 | −48 |
| 21 | 2.413 | 257 | 806 | 2.667 | 272 | 853 | −47 |
| 22 | 2.413 | 252 | 791 | 2.667 | 266 | 837 | −46 |
| 23 | 2.413 | 247 | 776 | 2.667 | 261 | 820 | −44 |
| 24 | 2.413 | 242 | 761 | 2.667 | 256 | 803 | −42 |
| 25 | 2.413 | 237 | 746 | 2.667 | 250 | 786 | −40 |
| 26 | 2.413 | 233 | 731 | 2.667 | 245 | 770 | −39 |
| 27 | 2.413 | 228 | 715 | 2.667 | 240 | 753 | −38 |
| 28 | 2.413 | 223 | 700 | 2.667 | 234 | 736 | −36 |
| 29 | 2.413 | 218 | 685 | 2.667 | 229 | 719 | −34 |
| 30 | 2.413 | 213 | 670 | 2.667 | 224 | 703 | −33 |
| 31 | 2.413 | 208 | 655 | 2.667 | 218 | 686 | −31 |
| 32 | 2.413 | 204 | 640 | 2.667 | 213 | 669 | −29 |
| 33 | 2.413 | 199 | 624 | 2.667 | 208 | 652 | −28 |
| 34 | 2.413 | 194 | 609 | 2.667 | 202 | 636 | −27 |
| 35 | 2.413 | 189 | 594 | 2.667 | 197 | 619 | −25 |
| 36 | 2.413 | 184 | 579 | 2.667 | 192 | 602 | −23 |
| 37 | 2.413 | 179 | 564 | 2.667 | 186 | 585 | −22 |
| 38 | 2.413 | 175 | 549 | 2.667 | 181 | 569 | −20 |
| 39 | 2.413 | 170 | 533 | 2.667 | 176 | 552 | −19 |
| 40 | 2.413 | 165 | 518 | 2.667 | 170 | 535 | −17 |
| 41 | 2.413 | 160 | 503 | 2.667 | 165 | 518 | −15 |
| 42 | 2.413 | 155 | 488 | 2.667 | 160 | 502 | −14 |
| 43 | 2.413 | 150 | 473 | 2.667 | 154 | 485 | −12 |
| 44 | 2.413 | 146 | 458 | 2.667 | 149 | 468 | −10 |
| 45 | 2.413 | 141 | 442 | 2.667 | 144 | 451 | −9 |
| 46 | 2.413 | 136 | 427 | 2.667 | 138 | 434 | −7 |
| 47 | 2.413 | 131 | 412 | 2.667 | 133 | 418 | −5 |
| 48 | 2.413 | 126 | 397 | 2.667 | 128 | 401 | −4 |
| 49 | 2.413 | 122 | 382 | 2.667 | 122 | 384 | −2 |
| 50 | 2.413 | 117 | 367 | 2.667 | 117 | 367 | 0 |
| 51 | 2.413 | 112 | 352 | 2.667 | 112 | 351 | +1 |
| 52 | 2.413 | 107 | 336 | 2.667 | 106 | 334 | +2 |
| 53 | 2.413 | 102 | 321 | 2.667 | 101 | 317 | +4 |

Total Length of Veneer on Small End = 37915 mm
Total Length of Veneer on Large End = 39903 mm It will be apparent from Table I that the cutting angle Angle A is constantly changing as the diameter of the bolt changes thereby gradually reducing the difference of length between the long edge (large end edge) 74 and the short edge (short end edge) 76 of the veneer 72 for each rotation of the bolt. Compare, for example, the first revolution which provides a length difference of about 79 mm with say the 25th revolution which produces a length difference of only 41 mm.

Thus, the amount of correction necessary (angle of the clipping knife to the axis of rotation of the bolt) is reduced as peeling continues.

Table II, is an example of five consecutive clips illustrating one example of how a correction may be applied based on the five clipping strategies. In the particular example shown in Table II clip number 1 is the starting clip which is radial relative to the initial curvature of the veneer.

TABLE II

| Clipping Cut No. | Min Arc Length from Prev Cut, m | Diff. in Edge Lengths mm |
|---|---|---|
| 1A | Starting Cut | |
| 2A | 1.3 | 94 |
| 3A | 1.3 | 94 |
| 4A | 1.3 | 92 |
| 5A | 1.3 | 92 |

As indicated in Table II in following the practice described in relation to FIG. 5 the difference in edge lengths i.e. between the long edge 74 and the short 76 for each panel is indicated i.e. clip 2A which is defining one side of panel 300A cuts the edge 76 94 mm closer to edge 1A then it traverses the edge 74. Similarly edge 3A traverses edge 76 94 mm closer to clip 2A than it is when measured along the longer curved edge 74 so that the panel 300A and 400A are each narrower by 94 mm at their edge formed by the minimum radius edge 76 than the edge formed by the maximum radius edge 74 measured along the curved edges 74 and 76.

If the clipping strategy of FIG. 7 were used then the length C would be 94 mm as would the length C1 whereas the following two corrections would be 92 mm i.e. for the clips 4A and 5A in Table II.

It will be apparent that when defects are present in the veneer and the clipper is triggered in the conventional manner the procedure of the present invention will be reinstated after the defect is removed (the clips to remove the defect will when practicing the present invention normally be made with the clipper blade at the appropriate angle-radial to help in correcting for the differences in length of the two sides of the veneer).

Having described the invention modifications will be evident to those skilled in the art without departing from spirit of the invention as defined in the appended claims.

I claim:

1. An apparatus clipping curved veneer having one side edge of a longer radius than the other side edge into discreet segments each defined by a pair of opposed curved side edges one longer than the other and a leading and trailing end edge comprising peeling a block of wood rotating on an axis using a peeling edge at an acute angle to said axis of rotation, a clipper knife, means for adjusting the angle of said clipper knife to said axis of rotation to clip said veneer into discreet panels each having its leading and trailing edges substantially radial to the curvature of said veneer adjacent each of said leading and trailing edges.

2. An apparatus of forming veneer panels combining means for sensing a wooden bolt to determine size of said bolt and its taper means for positioning said bolt for rotation on an axis of rotation based on the size and taper of said bolt sensed by said sensing means, means to rotate said bolt on said axis of rotation, a peeling knife, means for adjusting the angular position of said peeling knife to said axis of rotation of said bolt in accordance with the sensed taper of said bolt thereby to peel a veneer having a longer and a shorter curved side edge, a clipper knife closely coupled relative to said peeling knife along a path of travel of said veneer from said peeling knife, computer means for determining the curvature of at least one said longer and shorter curved side edges to determine the direction of radius curvature of the veneer adjacent the location of the clipped edge based on the size of said bolt the cutting angle of said peeling knife and the position of said peeling knife, means to angularly adjust said clipper knife to extend substantially radially of the determined curvature of said veneer adjacent to said clipper knife when said clipper knife is actuated to clip said veneer into discreet elements.

3. An apparatus as defined in claim 1 further comprising a second clipper knife and means to angularly adjust the position of second clipper knife.

4. An apparatus as defined in claim 3 wherein said clipper knife clips substantially radially of the curvature of said veneer at the location of each clip made by said clipper knife and wherein the angular position of said second clipper knife is adjusted to clip substantially parallel to the immediately preceeding clip of said clipper knife.

5. An apparatus as defined in claim 2 further comprising a second clipper knife and means to angularly adjust the position of second clipper knife.

6. An apparatus as defined in claim 5 wherein said clipper knife clips substantially radially of the curvature of said veneer at the location of each clip made by said clipper knife and wherein the angular position of said second clipper knife is adjusted to clip substantially parallel to the immediately preceeding clip by said clipper knife.

* * * * *